US006833502B1

(12) United States Patent
Boatner

(10) Patent No.: US 6,833,502 B1
(45) Date of Patent: Dec. 21, 2004

(54) WIND CHIME APPARATUS

(76) Inventor: Bruce E. Boatner, 29507 Pebble Beach Dr., Murrieta, CA (US) 92563

( * ) Notice: Subject to any disclaimer, the term of this patent is extended or adjusted under 35 U.S.C. 154(b) by 61 days.

(21) Appl. No.: 10/446,453

(22) Filed: May 28, 2003

(51) Int. Cl.[7] ..... G10D 13/08
(52) U.S. Cl. ..... 84/402; 84/406; 84/404; 84/405; 84/407; 84/103
(58) Field of Search ..... 84/402, 406, 404, 84/405, 407, 103

(56) References Cited

U.S. PATENT DOCUMENTS

| | | | | |
|---|---|---|---|---|
| 1,697,574 A | | 1/1929 | Savonius | |
| 4,693,162 A | | 9/1987 | Lee | |
| 5,315,909 A | * | 5/1994 | Hsu | 84/404 |
| 5,402,700 A | * | 4/1995 | Cohen | 84/404 |
| 5,452,638 A | | 9/1995 | Yancy | |
| 5,612,500 A | * | 3/1997 | Liang | 84/402 |
| 5,648,624 A | | 7/1997 | Smith | |

* cited by examiner

*Primary Examiner*—Shih-Yung Hsieh
(74) *Attorney, Agent, or Firm*—Loyal McKinley Hanson

(57) ABSTRACT

A wind chime constructed according to the invention includes a rotating wind bell apparatus having a downwardly opening bell that is adapted to be suspended from a separate support structure. A bell-striking mechanism in the form of a striker is suspended movably from the bell in a position to strike the bell. A striker-moving mechanism in the form of an impeller connected to the striker causes the striker to move in response to a wind moving past the striker-moving mechanism and to strike the bell so that the bell produces a tone. A bell-rotating mechanism in the form of another impeller connected to the bell causes the bell to rotate in response to the wind moving past the bell-rotating mechanism in order to thereby vary the tone and produce tremolo or Doppler-like effects. In one embodiment, the bell-rotating mechanism includes a Savonius type impeller attached to the upwardly facing surface of a circularly shaped impeller base. Circularly shaped graphics are provided on the upwardly facing surface of the impeller base that combine with the S-shape of the impeller when viewed from above to simulate a Yin-Yang symbol.

6 Claims, 5 Drawing Sheets

WIND CHIME APPARATUS

BACKGROUND OF THE INVENTION

1. Technical Field

This invention relates generally to wind chimes and the like, and more particularly to a vertically suspended wind chime apparatus that operates in response to the wind to produce a pleasant chiming sound.

2. Description of Related Art

Wind chimes produce soft pleasing sounds when blown by the wind. One typical wind chime includes several chimes in the form of metal tubes suspended vertically from a frame. The chimes are suspended so that are free to swing about. A striker is included along with a wind driven striker-moving arrangement that is responsive to the wind (i.e., air moving past the wind chime). When the striker moves, it impacts the metal tubes as they swing about to produce gentle chiming sounds.

U.S. Pat. No. 4,693,162 provides an example of a wind chime. It is of the stationary or "seated" type, as opposed to the typical wind chime assembly that hangs from a tree branch or other support structure. The prime mover or impeller is of particular interest. It is a rotor of the Savonius type and it operates to rotate a striker that impacts a set of chimes.

U.S. Pat. No. 5,452,638 presents the concept of using different shapes and types of materials in the striker in order to produce different tones and introduce more unpredictability in the sounds produced. A wind responsive element in the form of a complex striker impacts a fixed set of chime tubes to create interest in tone and timbre. U.S. Pat. No. 5,648,624 substitutes an anemometer-type rotating member for the traditional clapper. Various other patents concern adjustable strikers, variations in hanging chime tubes, and other minor changes. Many new designs are actually electronic devices disguised as wind chimes. Thus, wind chimes continue to be an object of interest and users seek improved wind chime designs.

SUMMARY OF THE INVENTION

This invention addresses the need outlined above by providing a wind chime that includes a rotating wind bell apparatus (RWB) having a wind-driven bell and a wind-driven striker. The bell rotates and that produces a tremolo or Doppler-like effect when it is struck by the striker. The striker swings and rotates to introduce a wide range of effects, including sharp and soft impacts, glancing blows, and vibrating sounds. Pleasant sounds result, accompanied by interesting RWB movements.

To paraphrase some of the more precise language appearing in the claims and introduce the nomenclature used, a rotating wind bell apparatus constructed according to the invention includes (i) a downwardly opening resonator (i.e., referred to herein as a "bell") that is adapted to be suspended from a separate support structure, (ii) a striker mechanism connected to the bell that is adapted to function as means for striking the bell, and (iii) a striker-moving mechanism connected to the striker mechanism that is adapted to function as means for causing the striker to move and strike the bell in response to a wind moving past the striker-moving mechanism in order to thereby produce a tone. In addition, (iv) a bell-rotating mechanism is provided connected to the bell that functions as means for causing the bell to rotate in response to the wind moving past the bell-rotating mechanism in order to thereby vary the tone (i.e., produce a tone-varying effect).

For one embodiment, the bell-rotating mechanism includes a first length of flexible line that functions as means for attaching the bell-rotating mechanism to the separate support structure, the bell is suspended from the bell-rotating mechanism, the striker is suspended from the bell in a position at least partially within the bell, and the striker-moving mechanism is suspended from the striker with a second length of flexible line. The bell-rotating mechanism includes a first impeller (e.g., a Savonius type rotor) to which the first length of flexible line is connected and the striker-moving mechanism includes a second impeller (e.g., a sheet of material having at least one bend) to which the second length of flexible line is connected.

In addition, the bell-rotating mechanism includes a circularly shaped impeller base having an upwardly facing side and a downwardly facing side. The Savonius type rotor attached to the upwardly facing side of the impeller base, and the bell is suspended beneath the downwardly facing side. According to another aspect of the invention, the impeller base includes circular graphics on the upwardly facing side that combine with the shape of the rotor when viewed from above to represent a Yin-Yang symbol.

Thus, the RWB of the invention utilizes the property that when a resonating object (i.e., the bell) is rotated, a tremolo or Doppler-like effect is introduced into the tone. In addition, the RWB performs a unique combination of three individual movements that produce the chiming sounds. The RWB lends itself to graphics befitting its "Zen" nature to simulate the classic Taoist Yin-Yang symbol. It can be used alone, in an ensemble of several units distributed around a venue, or it can be combined into a mobile and hung from a single point. The following illustrative drawings and detailed description make the foregoing and other objects, features, and advantages of the invention more apparent.

DESCRIPTION OF THE PREFERRED EMBODIMENTS

Figure 1:
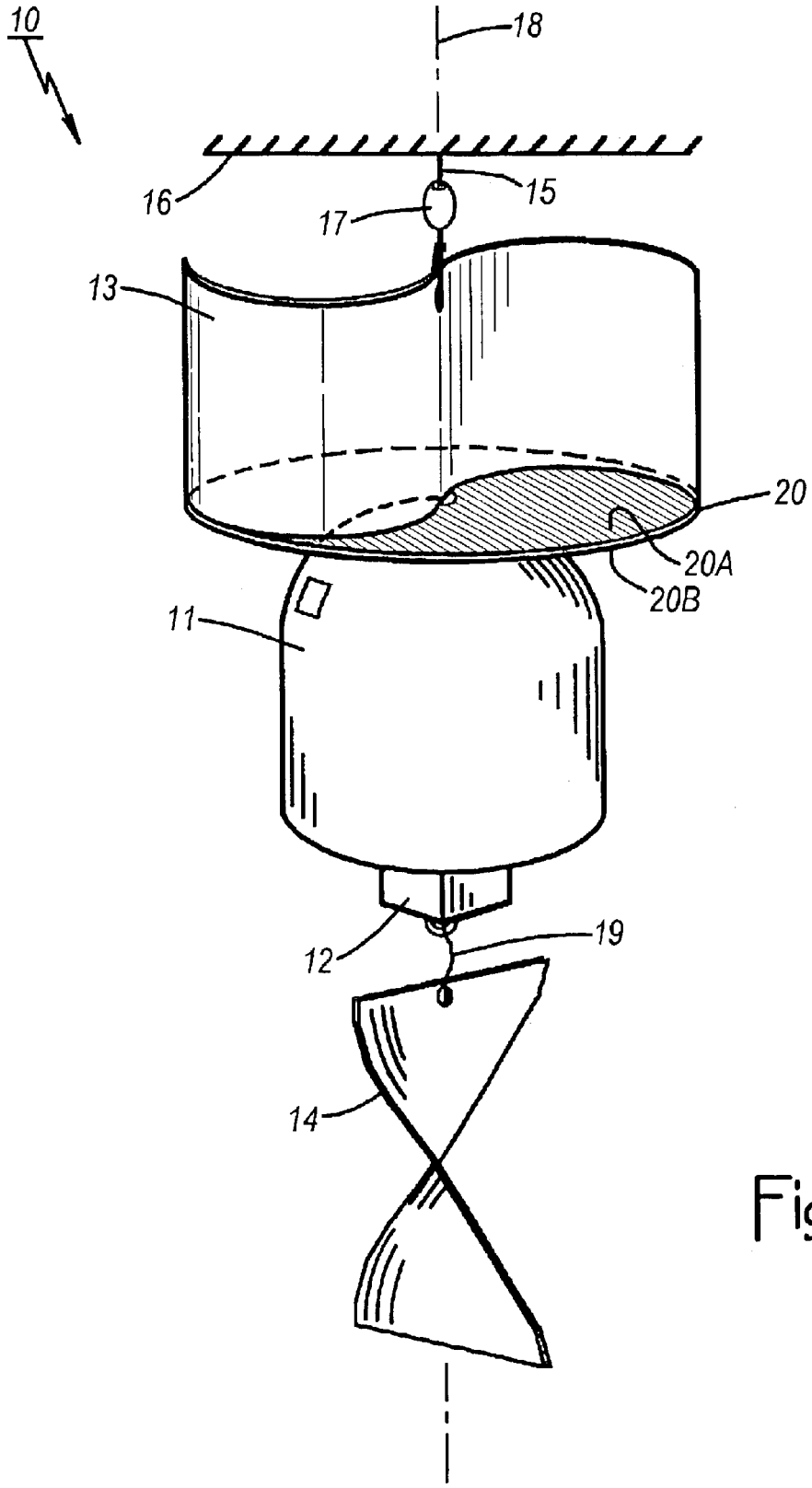
FIG. 1 of the drawings is an isometric view of a rotating wind bell apparatus constructed according to the invention.

FIGS. 1–6 of the drawings show various aspects of a rotating wind bell apparatus 10 constructed according to the invention. Referring first to FIG. 1, it shows that the apparatus 10 includes a downwardly opening resonator in the form of a metal bell 11, a striker mechanism in the form of a wooden striker 12 connected moveably to the bell 11, a bell-rotating mechanism in the form of a first impeller 13 connected to the bell 11, and a striker-moving mechanism in the form of a twisted rectangular sheet or second impeller 14 connected to the striker 12.

The striker 12 functions as means for striking the bell 11. The second impeller 14 functions as means for causing the striker 12 to move and strike the bell 11 in response to a wind moving past the second impeller 14 in order to thereby produce a tone. The first impeller 13 functions as means for causing the bell 11 to rotate in response to the wind moving past the first impeller 13 in order to thereby vary the tone (produce a tone-varying effect).

A first length of flexible line 15 (e.g., monofilament fishing line) is connected to a separate support structure 16 (e.g., a tree limb) and to the first impeller 13 via a swivel 17 (e.g., a fishing line swivel). Part of the first length of flexible line 15 extends between the support structure 16 and the swivel 17, while another part extends between the swivel 17 and the first impeller 13. So connected, the first length of flexible line 15 functions as means for supporting the apparatus 10 from the support structure 16 so that the first impeller 13 and the bell 11 are free to rotate about a rotational axis 18 in response to the wind.

A second length of flexible line 19 (e.g., monofilament fishing line) is connected to the striker 12 and to the second impeller 14, while a third length of flexible line (not shown) is connected to the striker 12 and the bell 11. The second length of flexible line 19 functions as means for supporting the second impeller 14 from the striker 12 while allowing rotational and sideways movement of the impeller 14 in response to the wind. The second and third lengths of flexible line also functions as means for storing rotational energy as the second impeller 14 and the striker 12 rotate. The first impeller 13 and the bell 11 rotate while the second impeller 14 rotates and swings about. This combination of actions causes the striker 12 to impact the bell 11 in unpredictable ways that produce the chiming sounds desired.

The bell 11 is adapted to be suspended from a separate support structure in the sense that it is connected to the first impeller 13 via an impeller base 20 so that supporting the first impeller 13 with the first length of flexible line 15 works to support the bell 11 also. The impeller base 20 is a disc-shaped piece of material having an upwardly facing surface 20A to which the first impeller 13 is attached by suitable means (e.g., glue) and a downwardly facing surface 20B beneath which the bell 11 is disposed. The bell 11 is connected to the impeller base 20 by an eyebolt-and-nut combination 21 shown in FIG. 3, while the striker 12 is connected to the bell 11 by the third length of flexible line mentioned above (not shown), the third length of flexible line being connected to the striker 12 and to the eyebolt-and-nut combination 21. The third length of flexible line connected to the striker 12 is similar to a third length of flexible line 22 connected to a striker 23 in FIG. 2*a*, a third length of flexible line 24 connected to a striker 25 in FIG. 2*b*, and a third length of flexible line 26 connected to a striker 27 in FIG. 2*c*.

Figure 2A:
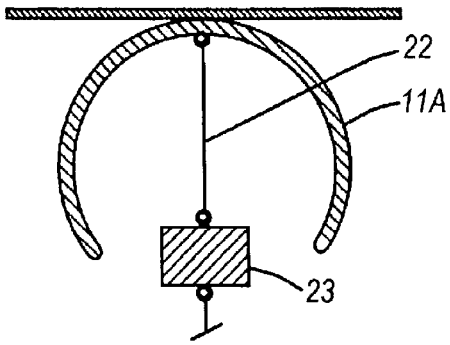
FIGS. 2*a*–2*c* are diagrammatic representations showing various resonator shapes in cross section, FIG. 2*a* depicting a spherically shaped resonator, FIG. 2*b* depicting a cylindrically shaped resonator, and FIG. 2*c* depicting a barrel-shaped resonator.
Figure 2B:
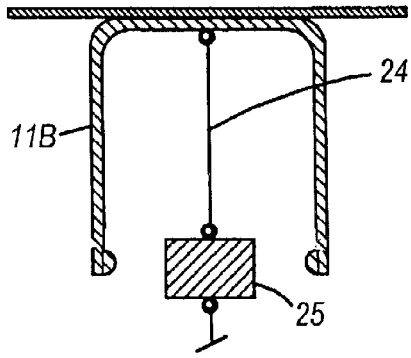
Figure 2C:
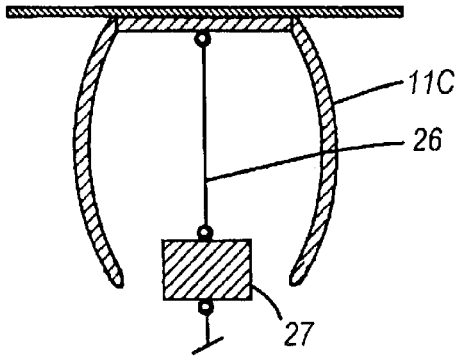
Figure 3:
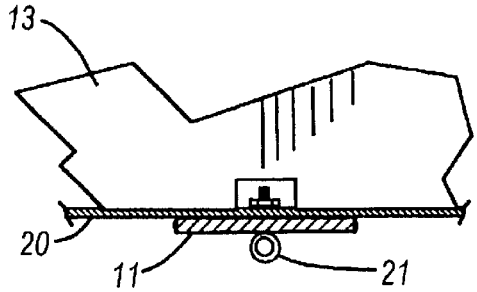
FIG. 3 is an enlarged elevation view of a portion of the rotating wind bell apparatus showing an eye bolt from which the striker is suspended.

Other bell-and-impeller arrangements may be employed within the inventive concepts disclosed, including having a bell supported directly by a first length of line, using a wind-driven rotor situated otherwise than directly above the bell. FIGS. 2*a*, 2*b*, and 2*c* show some alternate resonator shapes. These include a spherically shaped resonator 11A in FIG. 2*a*, a cylindrically shaped resonator 11B in FIG. 2*b*, and a barrel shaped resonator 11C in FIG. 2*c*. As an idea of size, the illustrated first impeller 13 of apparatus 10 is about 3.5 inches high in overall height, the bell 11 is about 4.5 inches in overall height, and the second impeller 14 is about 4.75 inches. Of course, those dimensions may vary significantly according to the precise RWB design. In addition, the first and second lengths of flexible line may be several inches long to improve their functioning. From the above and subsequent descriptions, one of ordinary skill in the art can readily implement a rotating wind bell apparatus according to the invention with many variations from those described.

Figure 4:
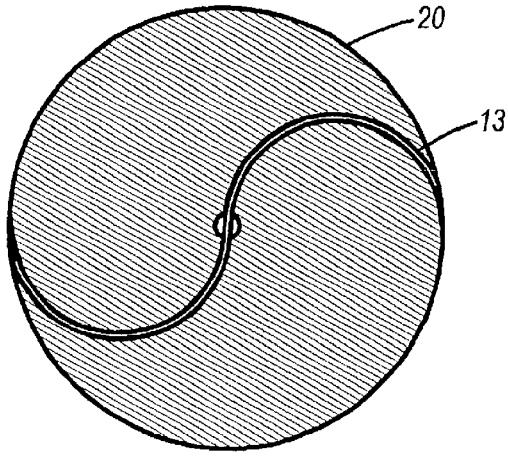
FIG. 4 is a plan view of just the primary impeller and impeller base.
Figure 5A:
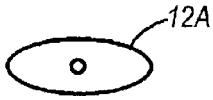
FIGS. 5*a*–5*d* are diagrammatic representations showing various striker shapes, FIG. 5*a* being a plan view of an oval shape, FIG. 5*b* being a plan view of a triangular shape, FIG. 5*c* being a plan view of a square shape, and FIG. 5*d* being a plan view of a star shape.
Figure 5B:
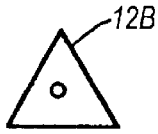
Figure 5C:
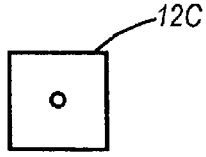
Figure 5D:
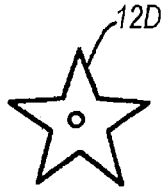

Any of various other types of wind driven rotors may be employed to rotate the bell 11. The illustrated first impeller 13 is a Savonius type rotor. It is referred to as a Savonius rotor in that U.S. Pat. No. 1,697,574 issued Jan. 1, 1929 to Savonius describes a rotor that now bears his name. In his own words, "the vane rotor consists of two oppositely arranged hollow shaped vanes of predominantly rectilinear generatrix, the inner edge of each vane catching the segmental space bordered by the other vane." Hence, the first impeller 13 is referred to as a Savonius rotor and it is generally S-shaped in cross section when viewed in a plane perpendicular to the rotational axis 18 as illustrated in FIG. 4.

The apparatus 10 produces a sonorous tone conducive to a relaxing mood, along with providing visual aesthetics and interest by means of unusual movement. The sound produced by the apparatus 10 is similar to a bell or gong. Since the resonator is never struck violently by the striker, the tone is generally rather subtle in keeping with the spirit of the design. Three distinct movements are apparent when observing the apparatus 10. First, the first impeller 13 turns the resonator bell 11, and although at times this assembly can rotate rather quickly, usually its motion will be slow and graceful. Since no swivel is completely free from friction, the system will slow and reverse direction occasionally to release tension in the first length of flexible line 15. Second, the smaller second impeller 14, which is attached to the striker 12 via the short second length of flexible line 19, spins freely and reverses directions frequently. Third, the striker 12, which is being influenced by the second impeller 14 and also to a lesser degree by the first impeller 13, attempts to keep up with the forces exerted on it, but being less massive than the bell 11 and more massive than the second impeller 14, rotates and alternates directions on its own schedule. Furthermore, when the striker 12 is randomly pulled into contact with the bell 11, it may stop spinning, or continue rotation, or reverse directions, depending on the conditions.

Although the illustrated first impeller 13 is a modified Savonius rotor, other types of wind-driven prime movers can be used without departing from the inventive concepts described, including such mechanisms as wind cups (anemometer), a Vertical Axis Wind Engine, a Rotating Display Apparatus, and so forth. The Savonius rotor is the most practical and aesthetically pleasing choice. The true Savonius design is typically flatter overall and has an opening along the center axis, allowing air to pass between the upwind and downwind portions, purportedly for improved performance. For simplicity and aesthetics of design, the simple S-shaped first impeller 13 is utilized. It is essentially two half-cylinder shapes placed edge to edge. This rotor can be fabricated from a single piece of material (e.g. sheet metal, plastic, etc.).

The disk-shaped impeller base 20 provides not only a means for is adding aesthetic appeal (it can be marked with the classic Yin-Yang sign) but also helps to introduce gyroscopic stability to the combination of the first impeller 13 and the bell 11 and to stabilize airflow past the first impeller 13. The apparatus 10 will function without the impeller base 20 installed, however, and so it may therefore be considered optional. The impeller base 20 may be fabricated from sheet metal, plywood, plastic, or any thin, rigid material.

The requirements of the bell 11 are that it should produce a resonant tone when struck and that it not be unreasonably heavy or massive. Its downwardly disposed open end should not be too wide in order to accommodate the range of the striker. The bell 11 is typically made of bronze or brass or other materials of good resonant quality.

The striker 12 may be most any shape, a rectangular parallelepiped shape being illustrated in FIG. 1. The shape of the striker 12 contributes to the variations of tone (i.e., the tone-varying effect) as it contacts the inner rim of the bell 11. The striker 12 can be fabricated from a range and combination of materials including wood, metal, rawhide, felt, plastic, hard rubber, etc., each having its own qualities of sound. Variations of size and weight will also affect performance, and should be considered in combination with the second impeller 14 to produce a desired movement and impact. FIGS. 5*a*, 5*b*, 5*c*, and 5*d* show some alternate striker shapes, including an oval (two-sided) shaped striker 12A in FIG. 5*a*, a triangle shaped striker 12B in FIG. 5*b*, a square shaped striker 12C in FIG. 5*c*, and a five-pointed star shaped striker 12D in FIG. 12*d*. Any of many other shapes may be used, such as pentagons, hexagons, and octagons. A round striker may also be employed, it will not produce the variation in sound of the multi-sided versions.

Although simple in appearance, design of the secondary impeller 14 is critical. This is because it performs multiple functions. First, it produces lateral impact movement of the striker 12 to produce sound. In addition, it animates the striker 12 by continuous, alternating rotation. It also introduces centrifugal stability into the pendulum of which the striker 12 is part by passing twisting motion back to the striker through the attaching line. This rotational energy is passed on and stored in the second length of flexible line 19.

Figure 6:
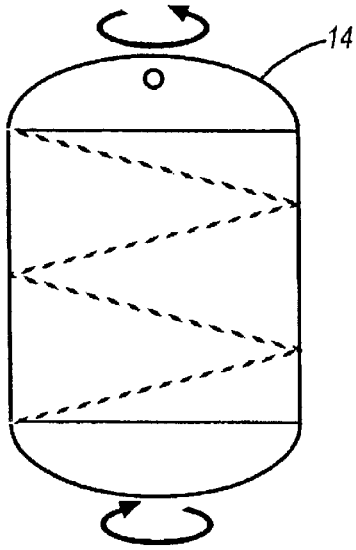
FIG. 6 is a diagrammatic representation showing further details of the second impeller design.

In order for the secondary impeller 14 to perform the above functions properly, it must possess certain characteristics. It must be light enough to be highly reactive in the wind, it must have a large enough profile to swing the striker, it must be an effective impeller, and it must be capable of reversing direction. Typically a single 45-degree to 90-degree twist in a piece of sheet metal of proper size and proportion is adequate to perform all of the required tasks. FIG. 6, it is a diagrammatic representation showing further details of the design of the second impeller 14. It shows the second impeller 14 (a sheet of metal) prior to twisting and illustrates the typical manner in which the piece of sheet metal will crease or bend when offset in the range of 45-degrees to 90 degrees. A pleasing design can be produced, along with the required 45-degree twist, by making a number of alternating diagonal bends in the flat piece of sheet metal.

The swivel 17 can be utilized at the main hanging point. Even if the swivel 17 does not rotate efficiently due to friction, it is useful in occasionally relieving tension in the first length of line 15 during periods of sustained wind. The capacity of the first length of line 15 to accommodate the constant transfer of energy is vital to the success of the design. Nylon monofilament fishing line has many characteristics that make it useful in this application. It is strong, weather-resistant, and is able to store and release rotational energy without unraveling or wear.

Both the combination of the first impeller 13, the impeller base 20, and the bell 11 (i.e., the bell assembly), and the striker 12, attain gyroscopic stability at certain rotational speeds. T the b ell assembly will generally be more stable than the striker 12, but if both the bell assembly and the striker 12 are completely gyroscopically stable, they will remain aligned on their mutually shared rotational axes (the rotational axis 18), allowing little or no contact between the two, and therefore no sound production. However, without gyroscopic stability, once the striker 12 contacts the edge of the rotating bell 11, it will simply stick there due to centrifugal forces.

A swivel assembly is not utilized in the second length of flexible line 19 (or in the third length of flexible line) because the striker 12 and second impeller 14 store and release energy in the lines as they continually reverse directions. At each spin reversal a state of momentary instability is introduced which allows the striker 12 to impact the bell 11 without getting stuck to the rim of the bell 11.

Figure 7A:
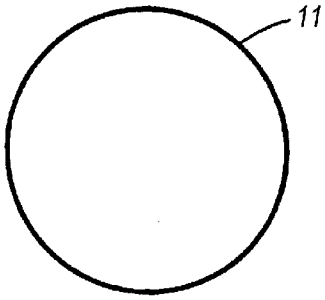
FIGS. 7*a*–*c* are diagrammatic representations showing various aspects of the resonance of a bell, bowl, gong, chime, or other resonator, FIG. 7*a* showing the resonator at rest, FIG. 7*b* illustrating deformation when the resonator is struck, and FIG. 7*c* showing the resonator stabilized into a standing wave pattern that produces air pressure waves.
Figure 7B:
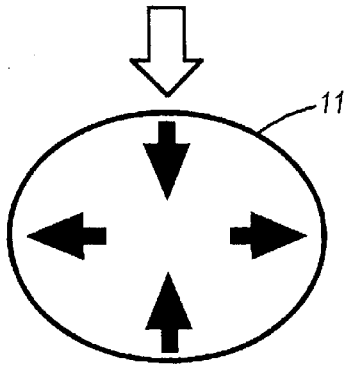
Figure 7C:
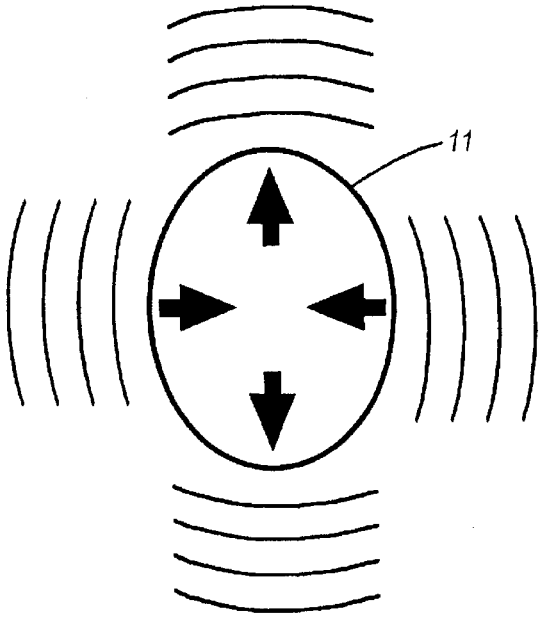

FIGS. 7*a*, 7*b*, and 7*c* shows the impact response of the rim of a resonant cylindrical object such as the bell 11. The resonator is at rest in FIG. 7*a*. FIG. 7*b* illustrates deformation when the resonator is struck, and FIG. 7*c* shows the resonator stabilized into a standing wave pattern that produces air pressure waves. An idealized visualization of this response shows the rim of the resonator creating a standing wave by alternately deforming in the vertical and horizontal directions. In reality the axes of compression and elongation can shift following initial impact, due to the material imperfections of the resonator. Nevertheless, after a short period the standing waves will stabilize, as can be witnessed by partially filling a resonator with water and observing the formation of symmetrical wave patterns. In order for a resonator to produce a long-lasting gong-like tone, which is desirable in this application, it must have walls of medium thickness. Thick-walled resonators, such as church bells, must be struck rather hard and ring with a strong, clear tone, which decays fairly slowly. The other extreme is something like a metal trash can that emits a rude noise of short duration at the slightest prevarication. Between these two extremes lie an infinite number of sounds produced by the impact of striker on various materials—gongs, cymbals, xylophones, glockenspiels, vibes, chimes, triangles, etc. All these resonators create standing waves of one kind or another.

The above-mentioned material imperfections in a resonator will affect the radiated sound characteristics in such a way as to produce an uneven pressure wave. This unevenness usually goes unnoticed by the observer because the point of reference is normally fixed. However, the rotation of a resonating body will allow a perceived modulation of tone equivalent to sampling the radiated acoustic energy at contiguous points around the source.

Figure 8:
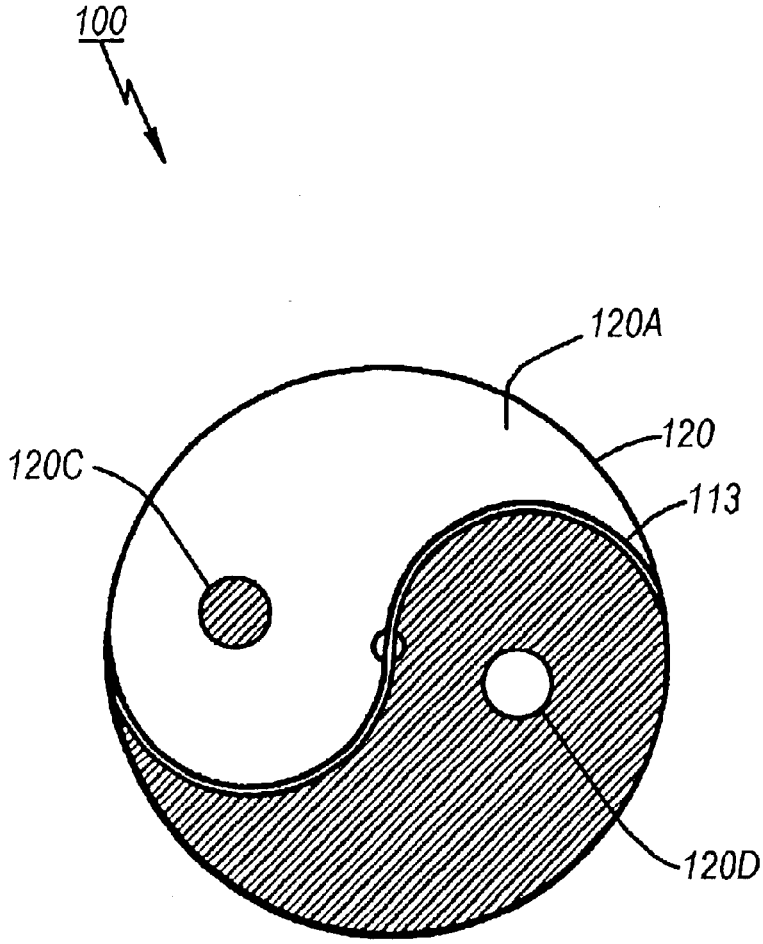
FIG. 8 is a plan view similar to FIG. 4 of just the impeller and impeller base of another rotating wind bell apparatus that utilizes the impeller element in combination with graphics on the impeller base to simulate the well known Taoist Yin-Yang symbol.

FIG. 8 is a plan view similar to FIG. 4 of a portion of another rotating wind bell apparatus 100 constructed according to the invention. The apparatus 100 is generally similar to the apparatus 10 and so only differences are described in further detail. For convenience, reference numerals designating parts of the apparatus 100 are increased by one hundred over those designating similar, related, or associated parts of the apparatus 10.

Just the S-shaped first impeller 113 and the disc-shaped impeller base 120 are illustrated in FIG. 8. Similar to the apparatus 100, the impeller base 120 of the apparatus 100 includes an upwardly facing surface 120A and the first impeller 113 is suitably attached to the upwardly facing surface 120A. In addition, circularly shaped graphics 120C and 120D are included on the upwardly facing surface 120A. The graphics 120A and 120C may take any of various forms, including stick-on or painted-on graphics. When viewed from above, the graphics combine with the circularly shaped surface 120A and the first impeller 113. The inclined shading lines in FIG. 8 indicate that the shaded portions are darker in appearance (e.g., black) than the non-shaded portions (e.g., white).

Thus, the invention provides a rotating wind bell apparatus (RWB) that significantly improves upon the prior art. Unlike the multiple tone wind chime in U.S. Pat. No. 5,452,638, the striker used in the RWB always impacts a uniform surface, the inner rim of the bell 11, and thus the production of different sound and effects is primarily dependent on the shape and movement of the striker 12, as affected by the second impeller 14. In addition, the striker 12 of the apparatus 10 is typically made of a single material, although a range of materials could be exploited to color the overall tonal qualities of the sound. Strikers made of multiple materials, such as a square with each corner a different material, could be utilized for effect, however the difference is that in the RWB this is not a fundamental claim to novelty. Perhaps most importantly, the RWB is a substantial departure from the traditional chime-and-striker wind chime configuration.

Concerning the wind chime having a rotating striker in U.S. Pat. No. 5,648,624, there are a large number of differences between it and the RWB. The second impeller 14 works in concert with the striker 12 to produce a fairly rapid back-and-forth rotation of both elements. This motion is based on the storage and release of energy in the suspension lines, making the use of an upper mounting bearing in the subsystem counter-productive. This motion is desirable not only for cyclical stability/instability transitional states, but also for the aesthetics of creating interesting movement.

In addition, the second impeller 14 of the RWB is specifically tailored to support the above-mentioned back-and-forth motion, while the anemometer is intended to turn efficiently in one direction only. This is why the RWB does not use a smaller version of the Savonius-type primary impeller as a secondary impeller, but instead uses the 45-degree to 90 degree vertical twist element which is much more unstable. By varying the rotational centerline of the second impeller 14 relative to the impinging airflow (due to blow-back in the wind), the aerodynamic properties of the element are instantaneously changed, allowing for spin reversal. However, the mass of the striker 12 also influences the timing of the spin reversal, acting like a flywheel to keep the transitions smooth. The aforementioned design is a derivation of the standard striker-and-chime approach, while the RWB is a substantial departure from the traditional wind chime configuration.

Although an exemplary embodiment has been shown and described, one of ordinary skill in the art may make many changes, modifications, and substitutions without necessarily departing from the spirit and scope of the invention.

What is claimed is:

1. A rotating wind bell apparatus, comprising:

a downwardly opening bell that is adapted to be suspended from a separate support structure;

a striker mechanism connected to the bell that functions as means for striking the bell;

a striker-moving mechanism connected to the striker mechanism that functions as means for causing the striker to move and strike the bell in a response to a wind moving past the striker-moving mechanism in order to thereby produce a tone; and to a bell-rotating mechanism connected to the bell that functions as means for causing the bell to rotate in response to the wind moving past the bell-rotating mechanism in order to thereby produce a tone-varying effect.

2. An apparatus as recited in claim 1, wherein:

the bell-rotating mechanism includes a first section of flexible line that functions as means for attaching the bell-rotating mechanism to the separate support structure;

the bell is suspended from the bell-rotating mechanism;

the striker is suspended from the bell in a position at least partially within the bell; and the striker-moving mechanism is suspended from the striker with a second section of flexible line.

3. An apparatus as recited in claim 2, wherein:

the bell-rotating mechanism includes a first impeller to which the first section of flexible line is connected; and the striker-moving mechanism includes a second impeller to which the second section of flexible line is connected.

4. An apparatus as recited in claim 3, wherein;

the bell-rotating mechanism includes a circularly shaped impeller base having an upwardly facing side and a downwardly facing side;

the first impeller is a Savonius type rotor attached to the upwardly facing side of the impeller base; and the bell is suspended beneath the downwardly facing side.

5. An apparatus as recited in claim 4, wherein the second impeller is a sheet of material having at least one bend.

6. An apparatus as recited in claim 5, wherein the impeller base includes circular graphics on the upwardly facing side that combine with the shape of the rotor when viewed from above to simulate a Yin-Yang symbol.

* * * * *